US011472613B2

(12) United States Patent
French et al.

(10) Patent No.: US 11,472,613 B2
(45) Date of Patent: Oct. 18, 2022

(54) SELECTIVELY OPENABLE CLOSURE FOR A CONTAINER

(71) Applicant: Berry Global, Inc., Evansville, IN (US)

(72) Inventors: Jordan Robert French, Evansville, IN (US); Seth A. Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 234 days.

(21) Appl. No.: 16/855,582

(22) Filed: Apr. 22, 2020

(65) Prior Publication Data

US 2020/0339318 A1 Oct. 29, 2020

Related U.S. Application Data

(60) Provisional application No. 62/837,495, filed on Apr. 23, 2019.

(51) Int. Cl.
*B65D 50/04* (2006.01)
*B65D 47/08* (2006.01)

(52) U.S. Cl.
CPC ..... *B65D 50/045* (2013.01); *B65D 47/0833* (2013.01); *B65D 2215/02* (2013.01); *B65D 2251/1016* (2013.01)

(58) Field of Classification Search
CPC ..... B65D 50/045; B65D 47/0833; B65D 2215/02; B65D 2251/1016; B65D 50/061
See application file for complete search history.

(56) References Cited

U.S. PATENT DOCUMENTS

| | | | |
|---|---|---|---|
| 2,704,100 | A | 3/1955 | Simon |
| 2,964,207 | A | 12/1960 | Towns |
| 3,204,800 | A | 9/1965 | Gottfried et al. |
| 3,398,848 | A | 8/1968 | Donovan |
| 3,432,065 | A | 3/1969 | Bugla |
| 3,450,290 | A | 6/1969 | Turner |
| 3,469,725 | A | 9/1969 | Turner |
| 3,584,760 | A | 6/1971 | Grinker |
| 3,612,322 | A | 10/1971 | Linkletter |
| 3,623,622 | A | 11/1971 | Sullivan |
| 3,693,820 | A | 9/1972 | Linkletter |
| 3,703,974 | A | 11/1972 | Boxer et al. |
| 3,716,161 | A | 2/1973 | Julian et al. |
| 3,739,933 | A | 6/1973 | Degaetano |
| 3,771,682 | A | 11/1973 | Chacos |
| 3,773,203 | A | 11/1973 | Grimaldi et al. |
| 3,782,578 | A | 1/1974 | Ballin |
| 3,871,662 | A | 3/1975 | Hepp et al. |
| 3,955,696 | A | 5/1976 | Finke |

(Continued)

FOREIGN PATENT DOCUMENTS

| | | | |
|---|---|---|---|
| CA | 2871813 | C | 5/2018 |
| CN | 105197392 | A | 12/2015 |

(Continued)

OTHER PUBLICATIONS

International Search Report and Written Opinion of corresponding international application No. PCT/US20/29307 dated Jul. 27, 2020, all enclosed pages cited.

*Primary Examiner* — Donnell A Long

(57) ABSTRACT

A closure for a container, and more specifically a closure that is selectively openable and/or lockable providing, for example, one or more child resistant opening features is disclosed.

20 Claims, 11 Drawing Sheets

(56) References Cited

U.S. PATENT DOCUMENTS 3,980,194 A 9/1976 Costa
4,049,148 A 9/1977 Suhr et al.
4,095,718 A 6/1978 Kong
4,128,184 A 12/1978 Northup
4,157,142 A 6/1979 Kong
4,171,749 A 10/1979 Aichinger et al.
4,337,869 A 7/1982 Guinle
4,346,809 A 8/1982 Kusz
4,361,243 A 11/1982 Virtanen
4,433,790 A 2/1984 Gibson
4,535,904 A 8/1985 Oconnor et al.
4,573,598 A 3/1986 Perry
4,832,218 A 5/1989 Gibilisco
4,895,282 A * 1/1990 Robinson ..... B65D 55/022 222/541.9
4,934,547 A * 6/1990 Mayes ..... A61B 10/007 215/250
4,941,580 A 7/1990 Julian
4,991,729 A 2/1991 Hunter
5,004,114 A 4/1991 Terbrusch et al.
5,040,691 A * 8/1991 Hayes ..... B65D 50/061 215/206
5,044,512 A 9/1991 Giancaspro et al.
5,161,706 A 11/1992 Weinstein
5,197,616 A * 3/1993 Buono ..... B65D 50/041 215/206
5,213,223 A * 5/1993 Minnette ..... B65D 25/42 215/221
5,299,701 A * 4/1994 Barker ..... G06M 1/248 215/218
5,316,161 A * 5/1994 Gargione ..... B65D 50/041 215/220
5,317,796 A 6/1994 Hunter
5,348,201 A 9/1994 Koo
5,370,251 A * 12/1994 Buono ..... B65D 50/041 215/230
5,397,008 A 3/1995 Glynn
5,398,829 A 3/1995 Stubbs
5,402,900 A 4/1995 Glynn
5,462,181 A 10/1995 Glynn
5,520,305 A 5/1996 Pierson
5,524,786 A 6/1996 Skudlarek
5,593,054 A 1/1997 Glynn
5,725,121 A 3/1998 Gianpaolo
5,727,704 A 3/1998 Glynn
5,779,072 A 7/1998 Krebs
5,797,511 A 8/1998 Elsdon et al.
5,803,785 A 9/1998 Primos et al.
5,957,318 A 9/1999 Banke et al.
5,984,125 A 11/1999 Price et al.
D419,369 S 1/2000 Naft et al.
6,056,144 A 5/2000 Strange et al.
6,095,354 A 8/2000 Herr et al.
6,116,477 A 9/2000 Kreiseder et al.
6,149,022 A 11/2000 Akyildiz et al.
6,170,683 B1 1/2001 Montgomery
6,202,876 B1 3/2001 Dejonge
6,254,451 B1 7/2001 Bean
6,318,683 B1 11/2001 Savoy
6,354,450 B1 3/2002 Zielinski et al.
6,382,444 B1 5/2002 Nyman
6,431,380 B1 8/2002 Branson
6,450,352 B1 9/2002 Dejonge
6,575,333 B1 6/2003 Raboin
6,655,499 B2 12/2003 Metheney
6,681,945 B1 1/2004 Harrold
6,763,960 B2 7/2004 Oh
6,866,164 B2 3/2005 Branson et al.
6,931,821 B2 8/2005 Wong
7,156,253 B2 1/2007 Ziegler
7,165,692 B2 * 1/2007 Konefal ..... B65D 50/04 215/220
7,185,776 B1 * 3/2007 Konefal ..... B65D 39/04 215/228
7,510,094 B1 * 3/2009 Willis ..... B65D 50/043 215/218
7,510,095 B2 3/2009 Comeau et al.
7,527,159 B2 5/2009 Brozell
7,686,183 B2 3/2010 Ziegler
7,748,293 B2 7/2010 Elwell
7,819,264 B2 10/2010 Brozell et al.
7,861,873 B1 1/2011 Bragg et al.
D643,722 S 8/2011 Gorskey et al.
8,205,762 B2 6/2012 Carroll
8,292,101 B1 10/2012 Bragg et al.
8,316,622 B2 11/2012 Jajoo et al.
D687,705 S 8/2013 Krupa
8,561,823 B1 10/2013 Krupa
8,636,168 B1 1/2014 Krupa
D701,429 S 3/2014 Krupa
8,794,460 B2 8/2014 Druitt et al.
D784,808 S 4/2017 Berroa Garcia
9,718,590 B2 8/2017 Dejonge
9,796,513 B2 10/2017 Ziegenfelder et al.
9,926,115 B2 3/2018 Jung et al.
9,950,844 B2 4/2018 Barber et al.
9,957,076 B2 5/2018 Tung et al.
9,981,789 B2 5/2018 Koller et al.
10,011,405 B2 7/2018 Dejonge
10,124,941 B2 11/2018 Sibley et al.
D839,730 S 2/2019 Wang
10,214,332 B2 2/2019 Eyal
10,239,673 B1 3/2019 Dejonge
10,246,230 B2 4/2019 Sangiovanni
10,272,599 B2 4/2019 Cerveny
10,322,856 B2 6/2019 Giraud et al.
10,689,169 B1 * 6/2020 Meshberg ..... B65D 47/0838
10,758,455 B2 * 9/2020 Fisher ..... A61J 7/0046
2004/0169000 A1 9/2004 Ramsey
2005/0072124 A1 4/2005 Jaycox
2005/0072792 A1 4/2005 Harrold
2006/0163190 A1 7/2006 Laveault et al.
2006/0163265 A1 7/2006 De
2006/0213861 A1 9/2006 Konefal et al.
2006/0273060 A1 12/2006 Fricke
2007/0144997 A1 6/2007 Hickey
2008/0116163 A1 5/2008 Sawyer
2008/0314860 A1 * 12/2008 Pugne ..... B65D 55/022 215/330
2009/0152270 A1 6/2009 Crowe et al.
2009/0188885 A1 7/2009 Nichols
2010/0005641 A1 1/2010 Druitt et al.
2010/0147732 A1 6/2010 Delagrance et al.
2010/0187247 A1 7/2010 Ziegler
2010/0206879 A1 8/2010 Lin
2010/0255436 A1 10/2010 Lu
2010/0264144 A1 * 10/2010 Nusbaum ..... B65D 47/0861 220/258.2
2011/0079058 A1 4/2011 Nielsen et al.
2011/0155688 A1 * 6/2011 Johnston ..... B65D 55/022 215/316
2012/0223077 A1 9/2012 Claypool et al.
2013/0081965 A1 4/2013 Stark
2018/0118423 A1 5/2018 Bois et al.
2019/0106251 A1 4/2019 Sterling et al.

FOREIGN PATENT DOCUMENTS

GB 2158048 B 9/1987
KR 1020080113688 A 12/2008
WO 2007103514 A2 9/2007
WO 2008154575 A1 12/2008
WO 2017125405 A1 7/2017
WO 2018081383 A1 5/2018
WO 2018081681 A1 5/2018
WO 2019066838 A1 4/2019

* cited by examiner

SELECTIVELY OPENABLE CLOSURE FOR A CONTAINER

PRIORITY CLAIM

This application claims priority under 35 U.S.C. § 119(e) to U.S. Provisional Application Ser. No. 62/837,495 filed Apr. 23, 2019, which is expressly incorporated by reference herein.

TECHNICAL FIELD

The present disclosure relates generally to a closure for a container, and more specifically to a closure that is selectively openable and/or lockable providing, for example, one or more child resistant opening features.

BACKGROUND

It is often desirable to make a container selectively openable by providing a closure for the container. For example, the closure may be selectively opened and closed and may include a locking or blocking feature that makes it more difficult or resistant to opening by a child.

SUMMARY

Certain embodiments according to the present disclosure provide a selectively openable closure for a container. Some embodiments may provide a closure that is resistant to opening by including two or more separate motions or user inputs to open, for example.

In one aspect, for instance, a package may be provided that includes a container defining a product storage region. The package may have a closure having a base and a lid. The base may be coupled to the container and the lid movable relative to the base between a closed position and an open position. There may be a locking protrusion on the base that extends in a radial direction from the base. There may be a collar coupled to the lid and having a side wall that is movable between a locked position, in which it prevents the lid from opening, and an unlocked position in which it allows the lid to open. A collar base bead may extend in a radial direction from the collar side wall. The locking protrusion on the base and the collar base bead may be in vertical alignment to prevent opening of the lid when the lid is in the closed position and the collar is in the locked position. The collar may be configured to be moved from the locked position to the unlocked position by a first user input, with the collar base bead out of vertical alignment with the locking protrusion to allow opening of the lid. The lid may be movable from the closed position to the open position by a second user input.

In another aspect, for instance, a closure and collar for a container may be provided. The closure may include a base and a lid. The lid may be movable relative to the base between a closed position and an open position. There may be a locking protrusion on the base that extends in a radial direction from the base. There may be a collar coupled to the lid and having a side wall that is movable between a locked position, in which it prevents the lid from opening, and an unlocked position in which it allows the lid to open. A collar base bead may extend in a radial direction from the collar side wall. The locking protrusion on the base and the collar base bead are in vertical alignment to prevent opening of the lid when the lid is in the closed position and the collar is in the locked position. The collar may be configured to be moved from the locked position to the unlocked position by a first user input, with the collar base bead out of vertical alignment with the locking protrusion to allow opening of the lid. The lid may be movable from the closed position to the open position by a second user input.

In yet another aspect, for instance, a package may be provided including a container defining a product storage region. The package may include a closure having a base and a lid. The base may be coupled to the container and the lid is movable relative to the base between a closed position and an open position. There may be a collar having a side wall that is movable between a locked position, in which it prevents a user from opening the lid, and an unlocked position in which it allows the user to open the lid. The collar is rotatable relative to the base by a user input to move the collar between the locked position and the unlocked position.

BRIEF DESCRIPTION OF THE DRAWINGS

The detailed description particularly refers to the accompanying figures, in which.

DETAILED DESCRIPTION

Embodiments now will be described more fully hereinafter with reference to the accompanying drawings, in which some, but not all embodiments are shown. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
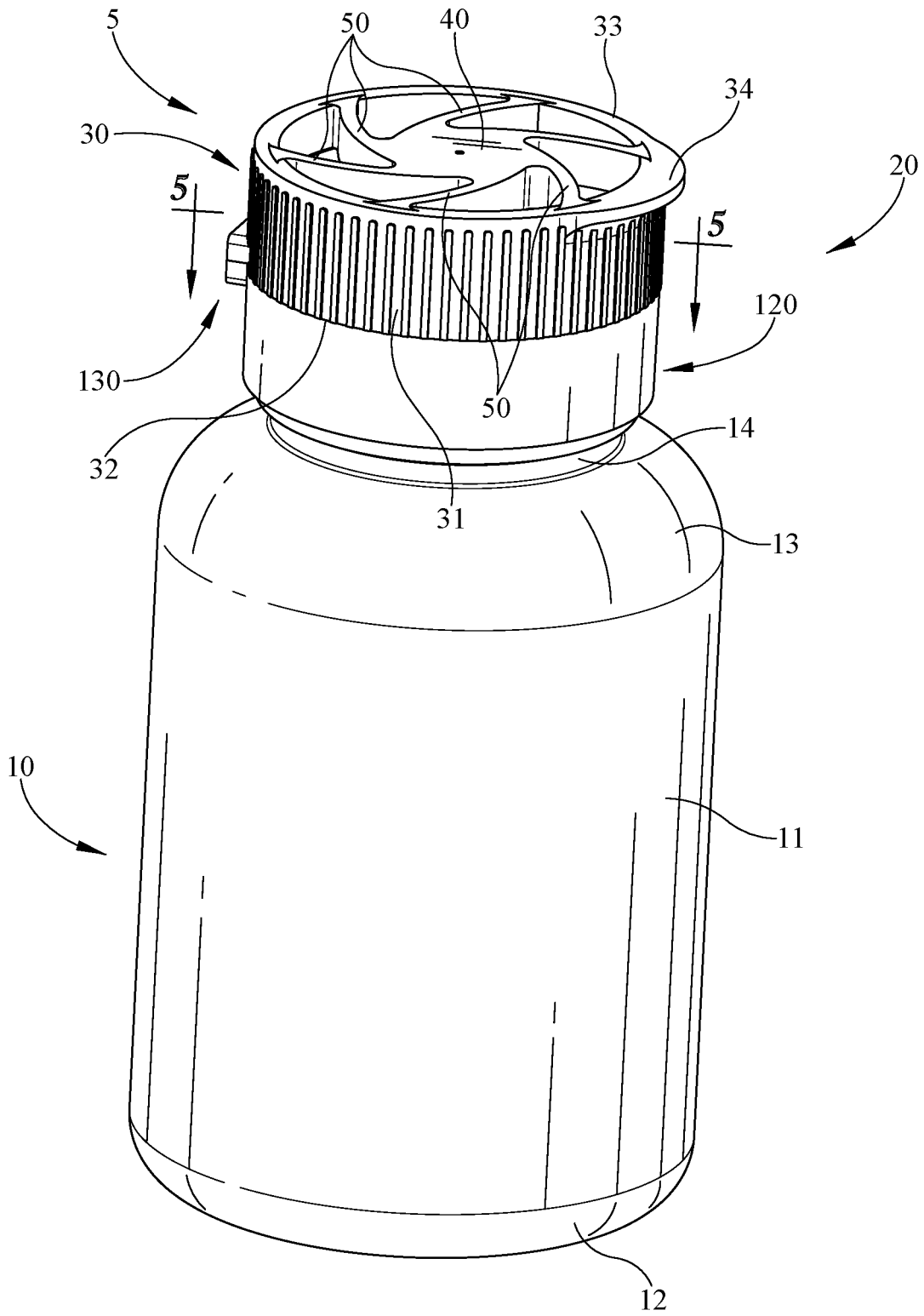
FIG. 1 illustrates a perspective view of an exemplary embodiment of a package that includes a container and a child-resistant closure in a closed position and a locked position.

Some embodiments of a package 5 such as shown in FIG. 1 may include a container or bottle 10 and/or a closure 20. If included, container 10 may include a side wall 11, a floor 12, and/or a shoulder 13, any or all of which may substantially define a product storage region in container 10. Package 5 is shown in FIG. 1 in an exemplary locked position and an exemplary closed position with closure 20 attached, coupled, and/or fastened to container 10 to substantially block, prevent, and/or inhibit access of a user to the product storage region and/or contents of package 5. For example, closure 20 may snap on or screw on to container 10. Closure 20 may be configured so that a user may selectively open and/or remove closure 20 from container 10 to provide package 5 in an open position so that, for example, the user may access contents of container 10 and/or package 5. Closure 20 may be provided such that a user may selectively reclose container 10 and/or package 5 by reclosing, reconnecting, or reattaching closure 20 to container 10.

Figure 2:
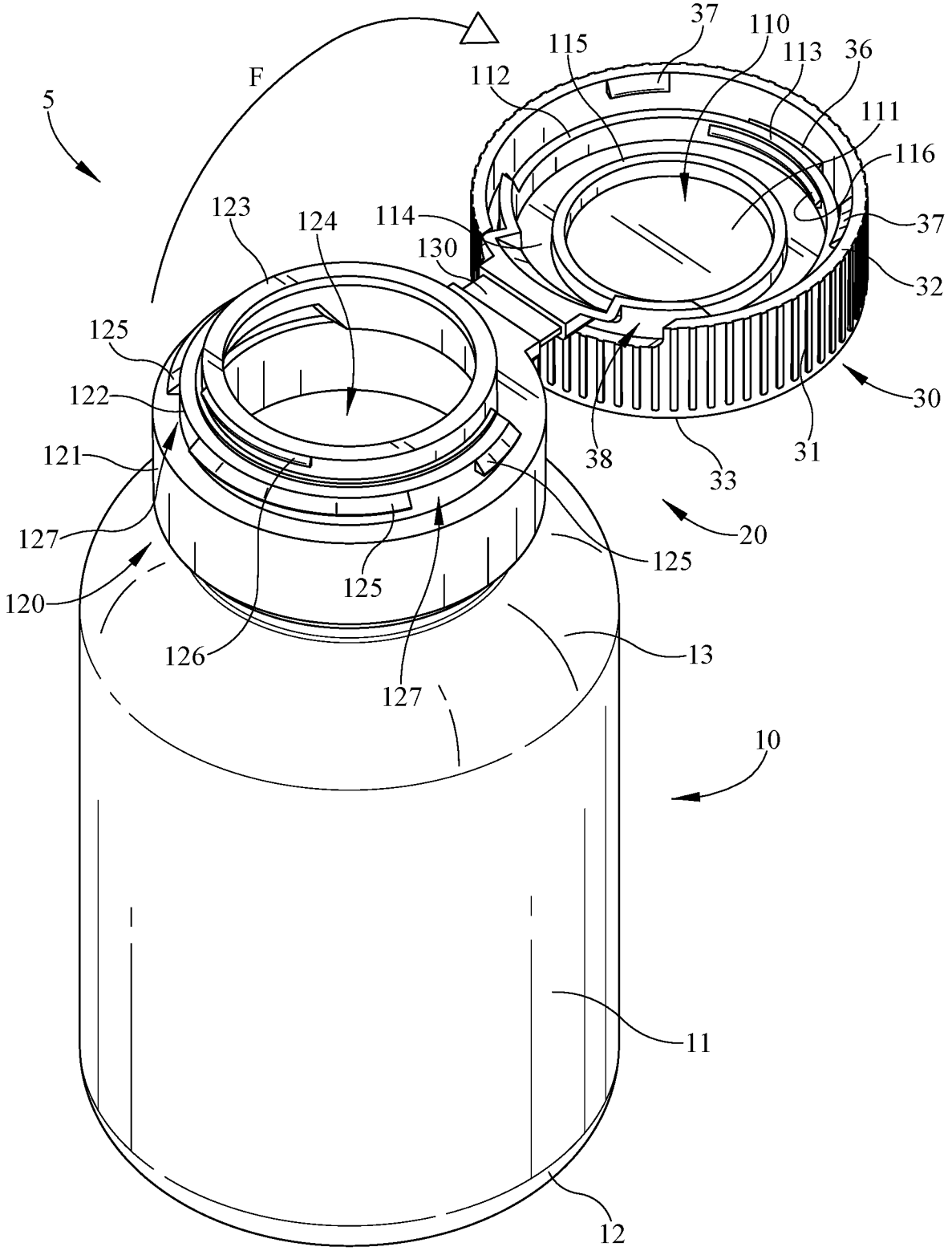
FIG. 2 illustrates a perspective view of the package of FIG. 1 shown in an open position.

Closure 20 may include a lid 110 that is selectively openable relative to a closure base 120 by one or more user inputs, and/or selectively closeable relative to closure base 120 to move lid 110 between the closed and/or locked position shown in FIG. 1 and the open position shown in FIG. 2. For example, lid 110 may include a lid lip 113, which may provide a snap fit or friction fit, for example, with a base bead 126, to facilitate a closed lid 110 that may be overcome and/or opened (e.g., "popped" open) by a user pushing up on lid 110 or some portion thereof to open lid 110 relative to base 120. For example, lid 110 may move and/or rotate upwardly relative to base 120 about a hinge 130 between the closed position and the open position.

To prevent or inhibit unwanted opening of lid 110, for example, or for any other reason or for any combination thereof, package 5 and/or closure 20 may include a locking mechanism such as a collar or locking collar 30. Collar 30 may be movable by a first user input between a locked position in which it blocks, prevents, and/or inhibits opening of lid 110 relative to base 120 and/or container 10, and an unlocked position in which lid 110 is and openable by a second user input. For example, the first user input may be rotation of collar 30 relative to lid 110 and/or base 120 from a locked position to an unlocked position. In this example, one or more collar base beads 37 may be vertically aligned with and/or create a mechanical stop with one or more base locking protrusions 125 to prevent an opening motion or second user input such as flip F, which may move lid 110 from the closed position to the open position. Collar 30 may be moved by a first user input, such as rotation or twist T shown for example in FIG. 9, from the locked position to an unlocked position in which collar base beads 37 are out of alignment with base locking protrusions 125 and/or the mechanical stop previously preventing opening is removed. In order to facilitate opening lid 110, for example, by flip F, collar 30 and/or lid 110 may be provided with collar lip 34, which may among other things provide a convenient surface for a user to engage when providing the second user input and/or opening flip F.

From the unlocked position, for example, a user may provide the second input such as flip F to open lid 110 and/or collar 30 relative to base 120 and/or container 10, as shown for example in FIG. 2. In some embodiments, closure 20 may include base 120, lid 110, and/or collar 30. Closure base 120 may include a skirt 121 that may be configured for engagement, attachment, and/or coupling with container 10. For example, skirt 121 may include a snap on type fit or engagement, such as a substantially permanent or semi-permanent snap feature (e.g., ridges or beads to snap on or over corresponding ridges or beads of container 10) for any of a variety of reasons, including but not limited to providing a child-resistant attachment of closure 20 to container 10. In some embodiments, an internal thread configured to cooperate with an external thread of container neck 14 to provide a threaded engagement and/or removal of closure 20 from to or from container 10. Base 120 may include a shoulder 122, which may be located above and/or radially inward of skirt 121. Locking protrusions 125 may, for example, be located at or near shoulder 122 and may extend radially outwardly from shoulder 122 but may be terminate prior to reaching an outward radial distance of an outer surface of skirt 121. In this way, for example, collar base beads 37 may lockingly engage locking protrusions 125 while collar 30 extends radially outwardly a distance equal to or less than skirt 121.

In some embodiments, collar base beads 37 may include an angled or cammed lower surface configured to engage with locking protrusions 125 to allow collar base beads 37 to slide or cam over locking protrusions 125 to allow lid 110 to move from the opened position to the close position even if collar 30 is in the locked position. In some embodiments, locking protrusions 125 may include an angled or cammed upper surface configured to engage with collar base beads 37 to allow collar base beads 37 to slide or cam over locking protrusions 125 to allow lid 110 to move from the opened position to the closed position even if collar 30 is in the locked position. In some embodiments, such as is shown in FIG. 2, collar base beads 37 may have angled or cammed lower surfaces and locking protrusions 125 may have angled or cammed upper surfaces, the combination of which may further facilitate closing lid 110 even if collar 30 is in the locked position.

As discussed more below, collar 30 may be biased toward the locked position so that, for example, it tends to stay in or move to the locked position in the absence of the first or unlocking user input. To facilitate locking and/or prevention or inhibition of opening from the locked position, either or both of an upper surface of collar base beads 37 and a lower surface of locking protrusions 125 may be substantially flat and/or horizontal when lid 110 is in the closed position to facilitate and/or provide a strong mechanical stop between them. While a snap fit or friction fit may be provided between lid bead 116 and/or base bead 126, it is understood that either or both of these may be substantially smaller and/or extend radially a shorter distance than collar base beads 37 and/or base locking protrusions 125, for any of a variety of reasons, including but not limited to providing a snap fit that may be readily overcome by a user when collar 30 is in the unlocked position, but that may be prevented from opening due to the locking engagement of collar base beads 37 and locking protrusions 125 when in the locked position.

In the unlocked position, collar base beads 37 may move through unlocking slots 127 relatively easily to allow lid 110 to move from the closed position to the open position, as shown in FIG. 2. In order to facilitate moving collar 30 between the locked and unlocked positions, collar 30 may be provided with a hinge recess 38, which may be provided so that a portion of collar side wall 31 may extend downwardly farther than hinge 130, while also allowing movement and/or rotation of collar 30 relative to hinge 130 with limited or no interference from hinge 130. Cover 110 may include a plug 115 to facilitate and/or provide a better fit and/or seal in cooperation with a rim 123 of base 120, or for any other reason or combination of reasons.

In some embodiments, such as shown in FIGS. 1 and 2, lid 110 may include a cover 111 and/or a lid skirt 112 that prevent, inhibit, and/or block access to an opening 124 into the product storage region when in the closed position shown in FIG. 1. Package 5 may be configured so that a user can hold container 10 in one hand, provide a first input by twisting, rotating, and/or moving collar 30 circumferentially relative to lid 110 and/or base 120 to unlock or unblock lid 110 so that it may be made to have upward movement or rotation, and provide a second input by pushing, pulling, moving, or rotating lid 110 from the closed position to the open position, for example, by pushing or pulling upwardly on collar lip 34 to cause rotation of lid 110 about hinge 130.

Figure 3:
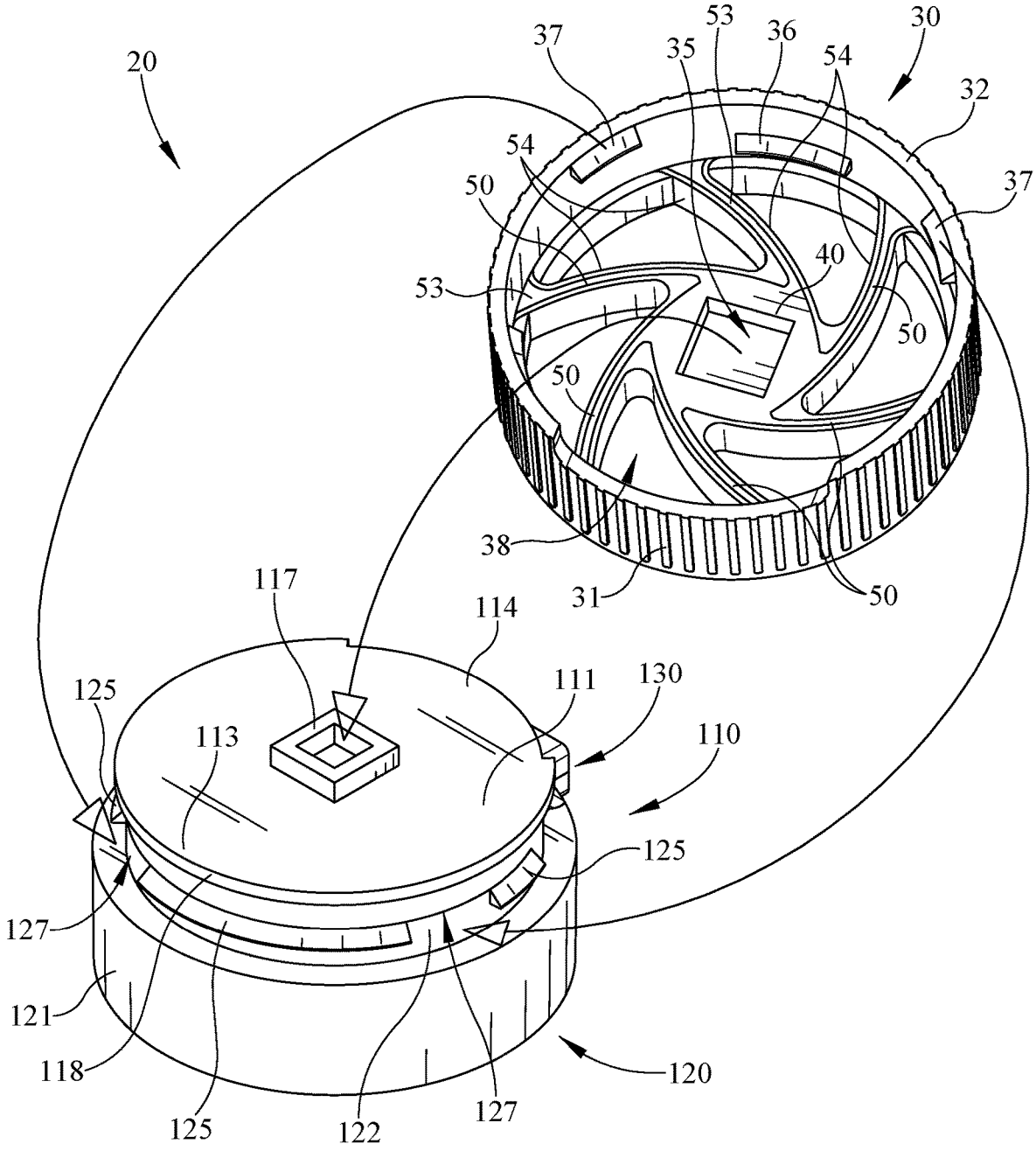
FIG. 3 illustrates an assembly view of an embodiment of a lid and locking collar.

Collar 30 may include a collar attachment mechanism, such as collar attachment portion 35, for engagement with a corresponding attachment mechanism of lid 110, such as lid attachment portion 117, shown for example in FIG. 3. FIG. 3 illustrates a top perspective view of lid 110 and base 120, and a bottom perspective view of collar 30. Attachment recess 35 may be located at or near a bottom surface of collar 35 and/or may extend at least partially through collar 30, for example, in a vertical direction. Collar attachment portion 35 and lid attachment portion 117 may be configured so that rotation of a hub 40 of collar 30 relative to lid 110 is prevented or inhibited. For example, collar attachment portion 35 may include a non-circular recess and lid attachment portion 117 may include a similarly sized and shaped protrusion for mating with the recess 35, such that rotation of one will induce rotation of the other. It is understood that the arrangement could be reversed, for example, with lid attachment portion 117 being a recess and collar attachment portion 35 being a protrusion. It is further understood that other attachment mechanisms suitable for preventing relative rotation of collar attachment portion 35 and lid attachment portion 117 may be included.

The relative motion of a portion of collar 30, such as collar side wall 31, relative to lid 110 and/or base 120 may be provided and/or facilitated by one or more flexible or deflectable members, such as spokes 50. Spokes 50 may be configured to flex to allow rotation of collar side wall 31 and/or movement of collar 30 between the unlocked and locked position. Spokes 50 may be biased toward the locked position so that collar 30 and/or collar side wall 31 tends to return to the locked position in the absence of the first user input and/or twist T. Spokes 50 may be made to flex in a variety of ways, including but not limited to being formed in the shape and configuration shown in FIG. 3, being formed to include an elastomeric material such as thermoplastic elastomer (TPE) for example, other plastic material, rubber, or any other material or way of providing elasticity, or any combination thereof. Any or all of spokes 50 may be formed of one or more components, such as a center component 53 and an outer component 54. For example, in some embodiments, center component 53 may be formed of a relatively rigid material such as polypropylene (PP) or other plastic material, which may be the same material as collar side wall 31, for example, so that center components 53 and side wall 31 may be molded together. Outer components 54 may be formed of a softer and/or more elastic material, such as TPE, to provide additional flexibility to spokes 50, for example. In some embodiments, TPE may be overmolded onto center components 53 in a secondary molding operation.

Figure 4:
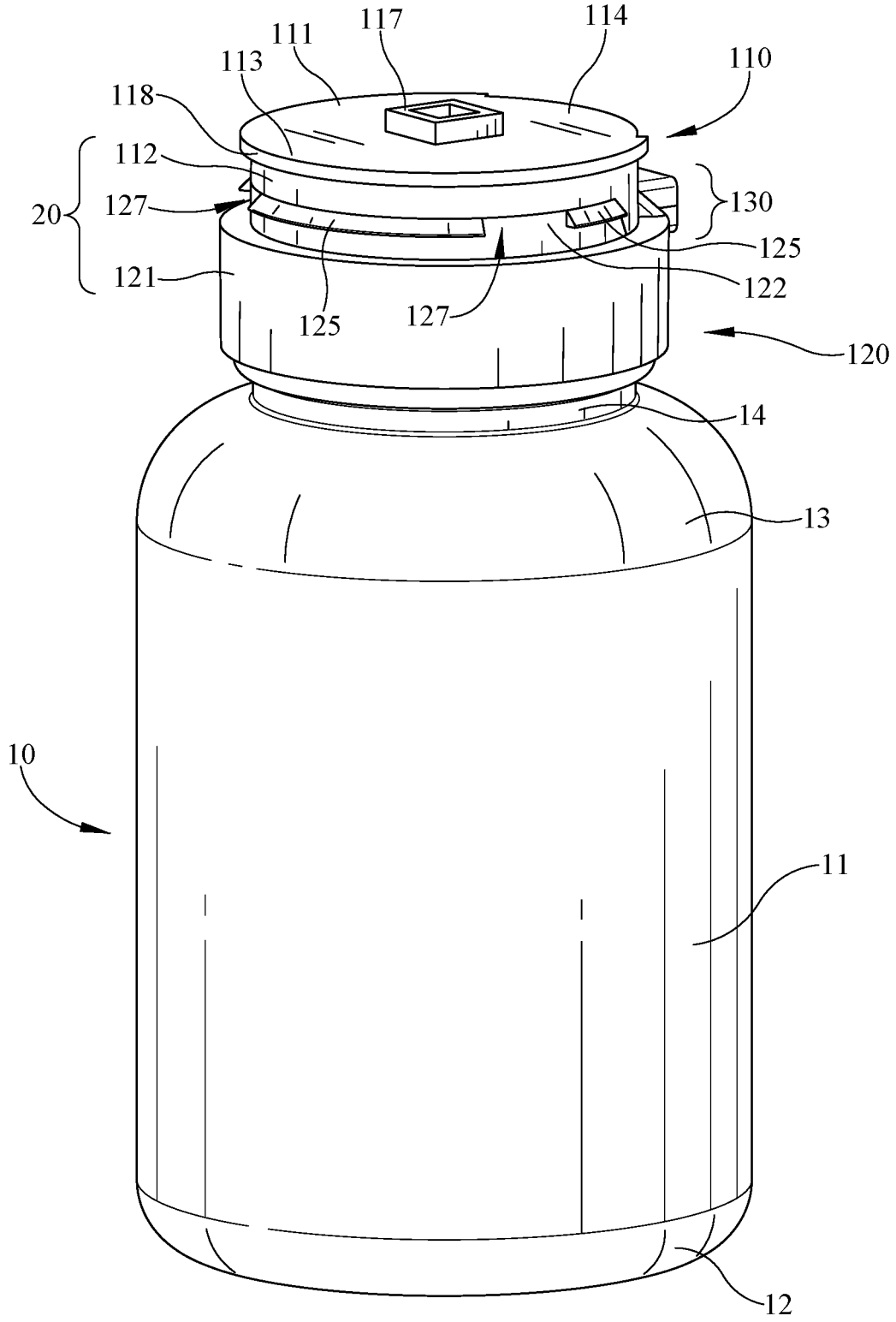
FIG. 4 illustrates a perspective view of the package of FIG. 1 shown with the locking collar removed.
Figure 5:
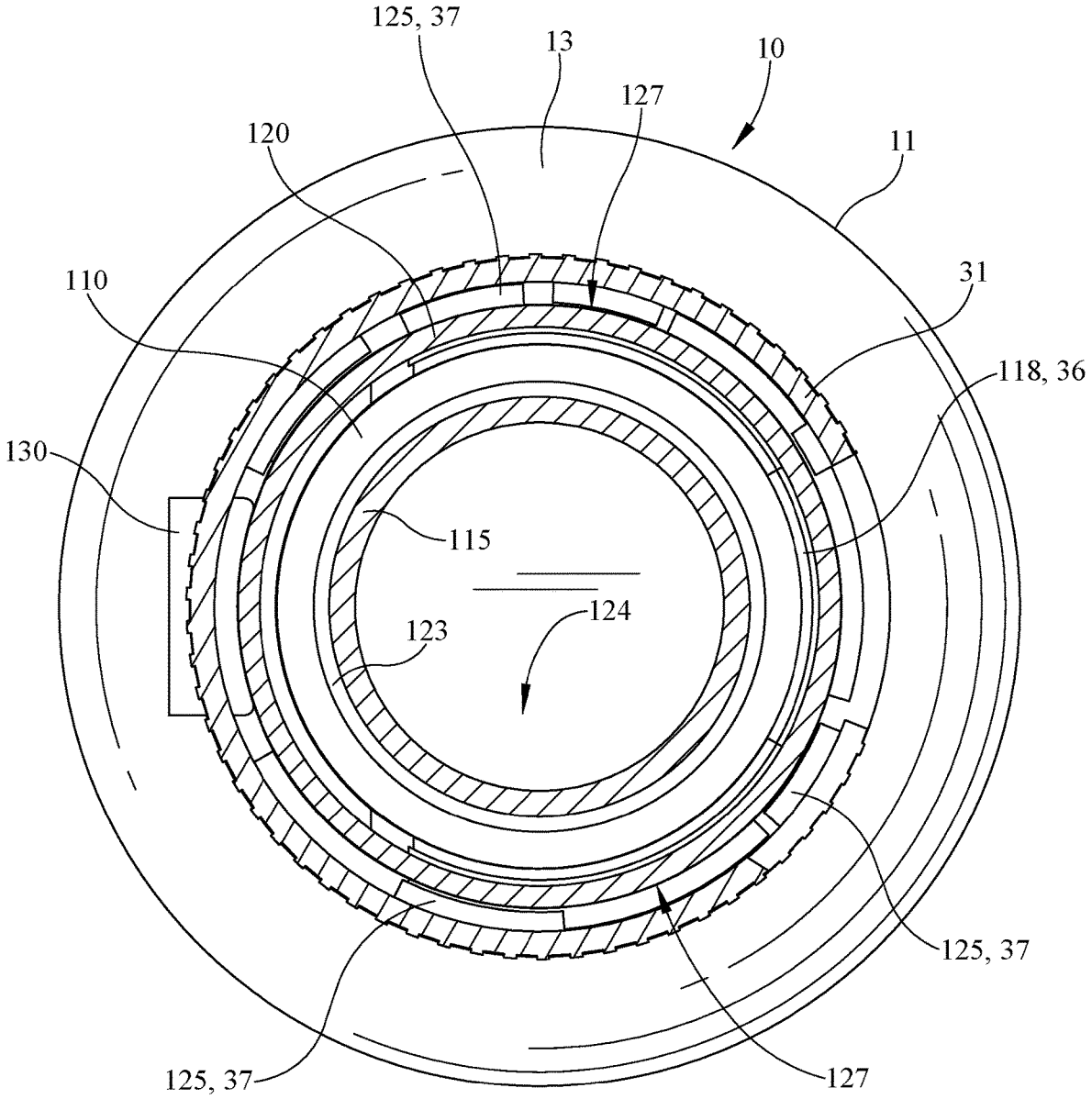
FIG. 5 illustrates a cross-section view of the package of FIG. 1, taken along line 5-5.

FIG. 4 shows package 5 without collar 30, to further illustrate lid 110 and base 120 in a closed position on container 10. FIG. 5 illustrates a cross-section view taken through a portion of closure 20, to show among other things, the relationship of certain features of package 5, closure 20, and collar 30. For instance, in the locked position shown in FIG. 5, collar base beads 37 and base locking protrusions 125 are at least partially in vertical alignment to prevent or inhibit vertical motion of lid 110 relative to base 120.

Figure 6:
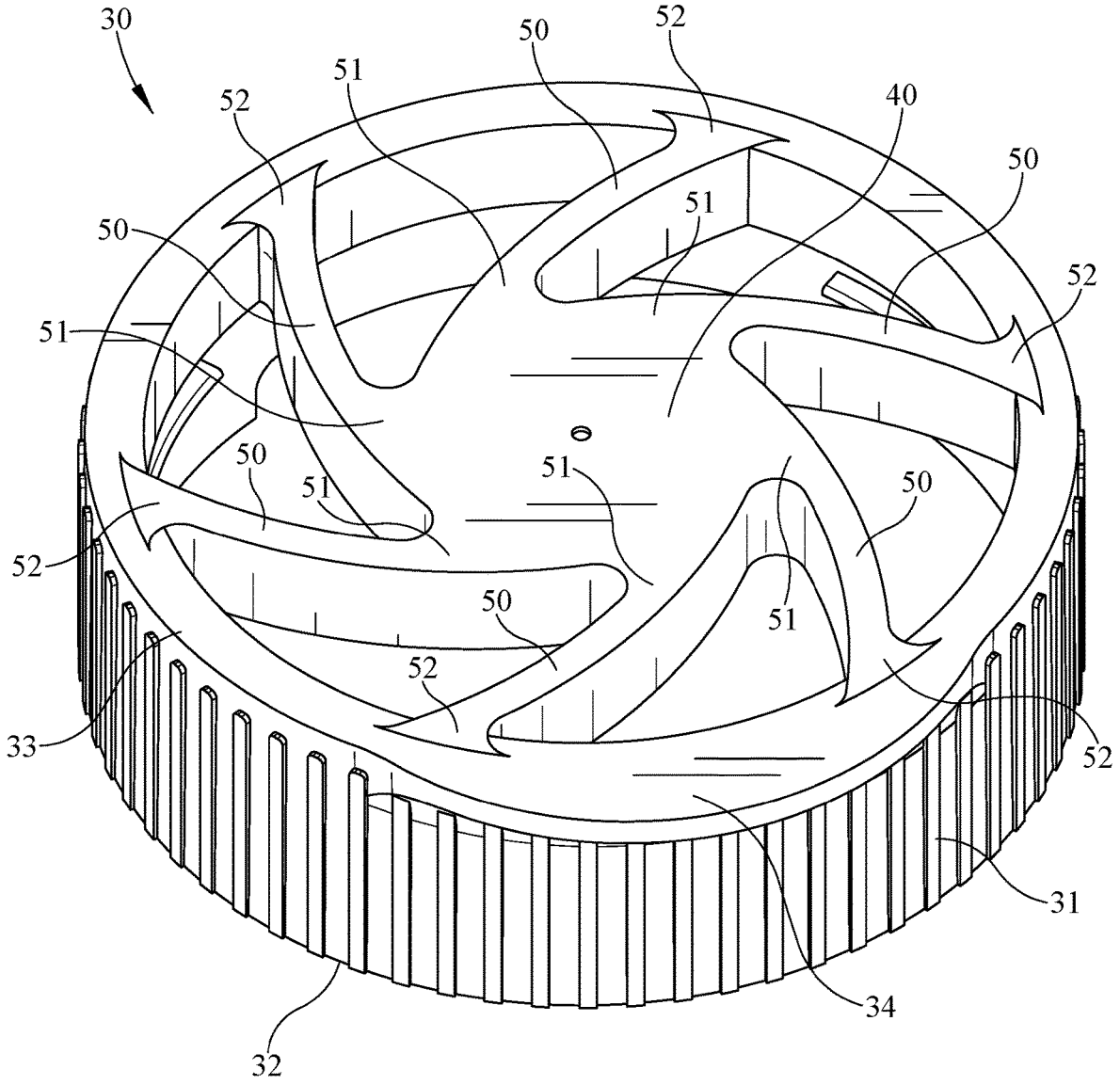
FIG. 6 illustrates a top perspective view of an embodiment of a locking collar.
Figure 7:
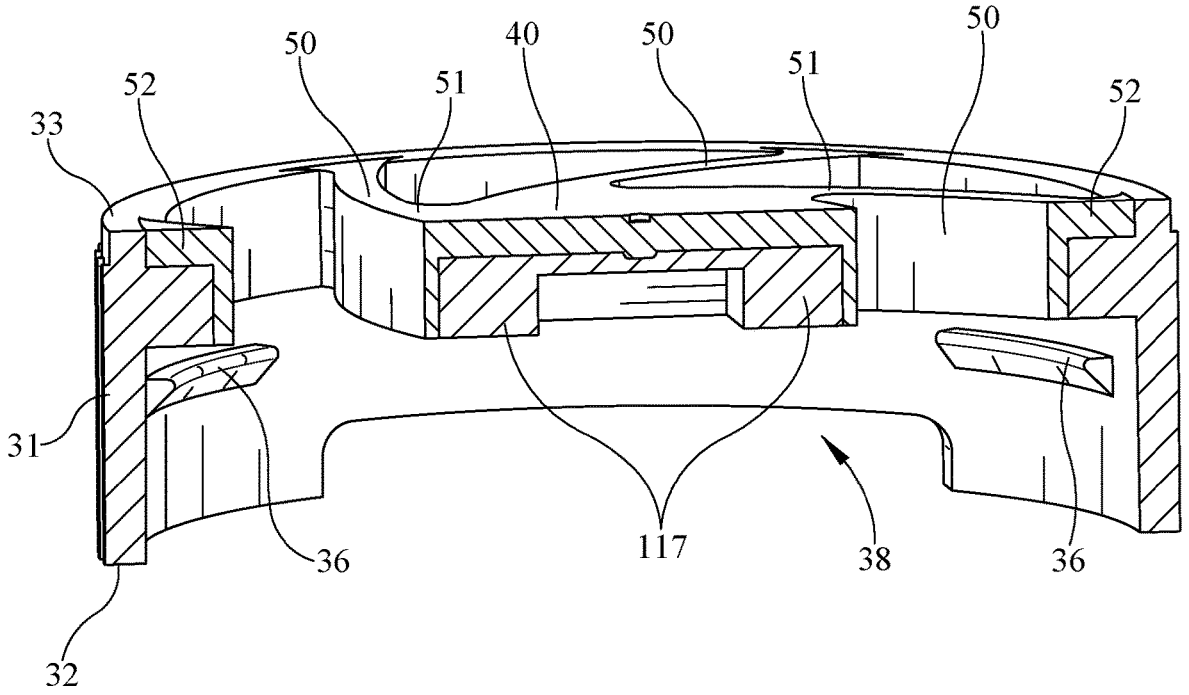
FIG. 7 illustrates a cross-section view of the locking collar of FIG. 6, and an embodiment of a lid attachment portion to which the locking collar is coupled.

FIG. 6 illustrates collar 30 in more detail from a top perspective view. In this embodiment, hub 40 of collar 30 may be centrally located and/or configured to attach to lid 110, base 120, and/or closure 20 in a way that substantially prevents or inhibits rotation of hub 40 relative to closure 20, as discussed above, for example. Spokes 50 may attach to hub 40 at a first spoke end 51 and may extend radially outwardly toward second spoke end 52, which may attach to, couple with, and/or be integrally formed with collar side wall 31. FIG. 6 illustrates one example of a resting state of collar 30, which would provide collar 30 in the locked position when coupled to closure 20. Movement or rotation of collar 30 relative to closure 20 may cause flexure or deflection of spokes 50, which may provide a spring-like element and/or biasing force back toward the resting state and/or locked position. An example of how collar 30 and/or spokes 50 may appear when in the flexed, deflected, and/or unlocked position, is shown for example in FIG. 11. The attachment of collar 30 to lid 110 via engagement of recess 35 of hub 40 and attachment portion 117 of lid 110 is shown in more detail, for example, in FIGS. 3 and 7.

Figure 8:
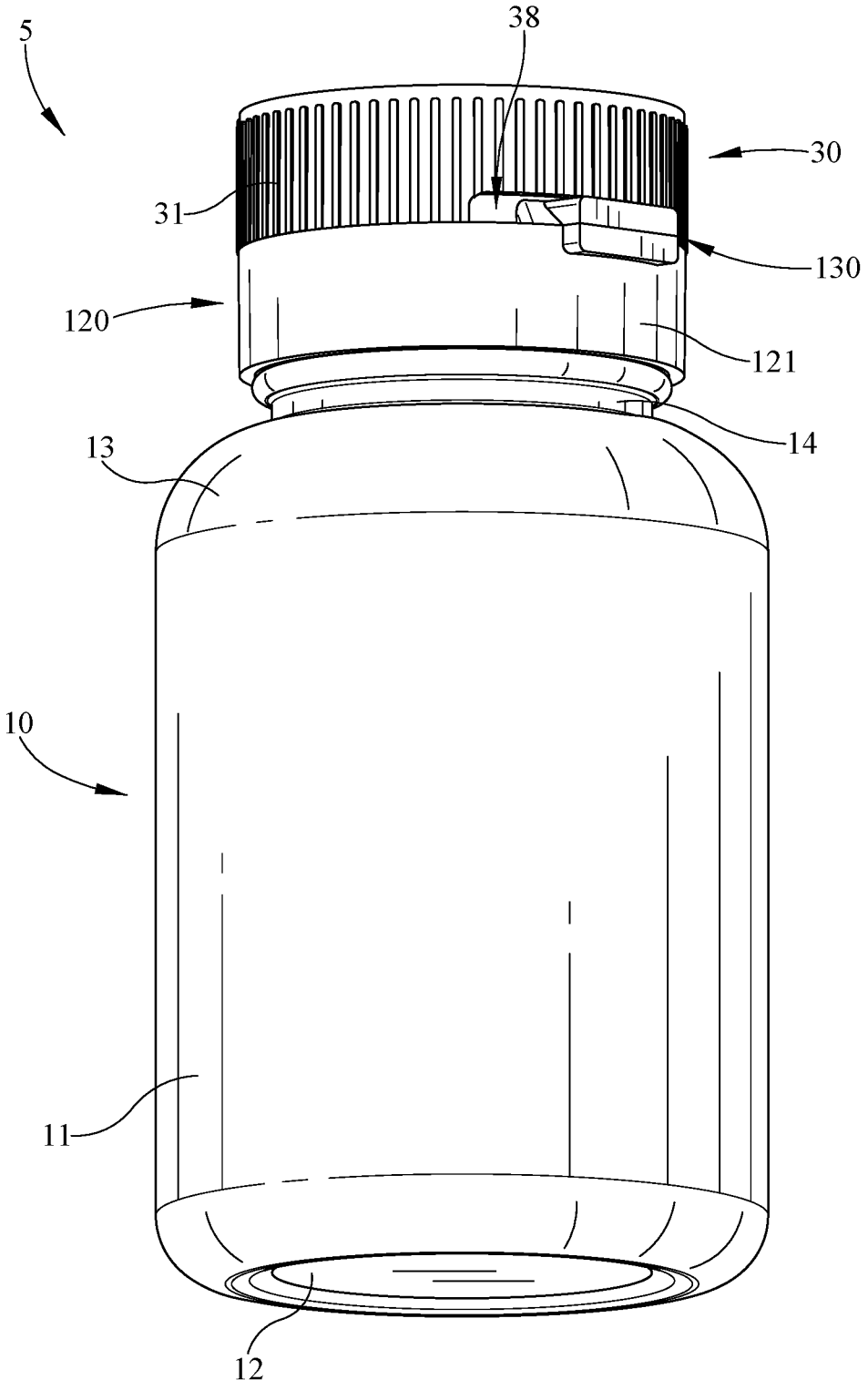
FIG. 8 illustrates a back perspective view of the package of FIG. 1, showing the locking collar in a locked position and a slot in the locking collar configured to allow at least some rotation of the locking collar without interference with an embodiment of a closure hinge.
Figure 9:
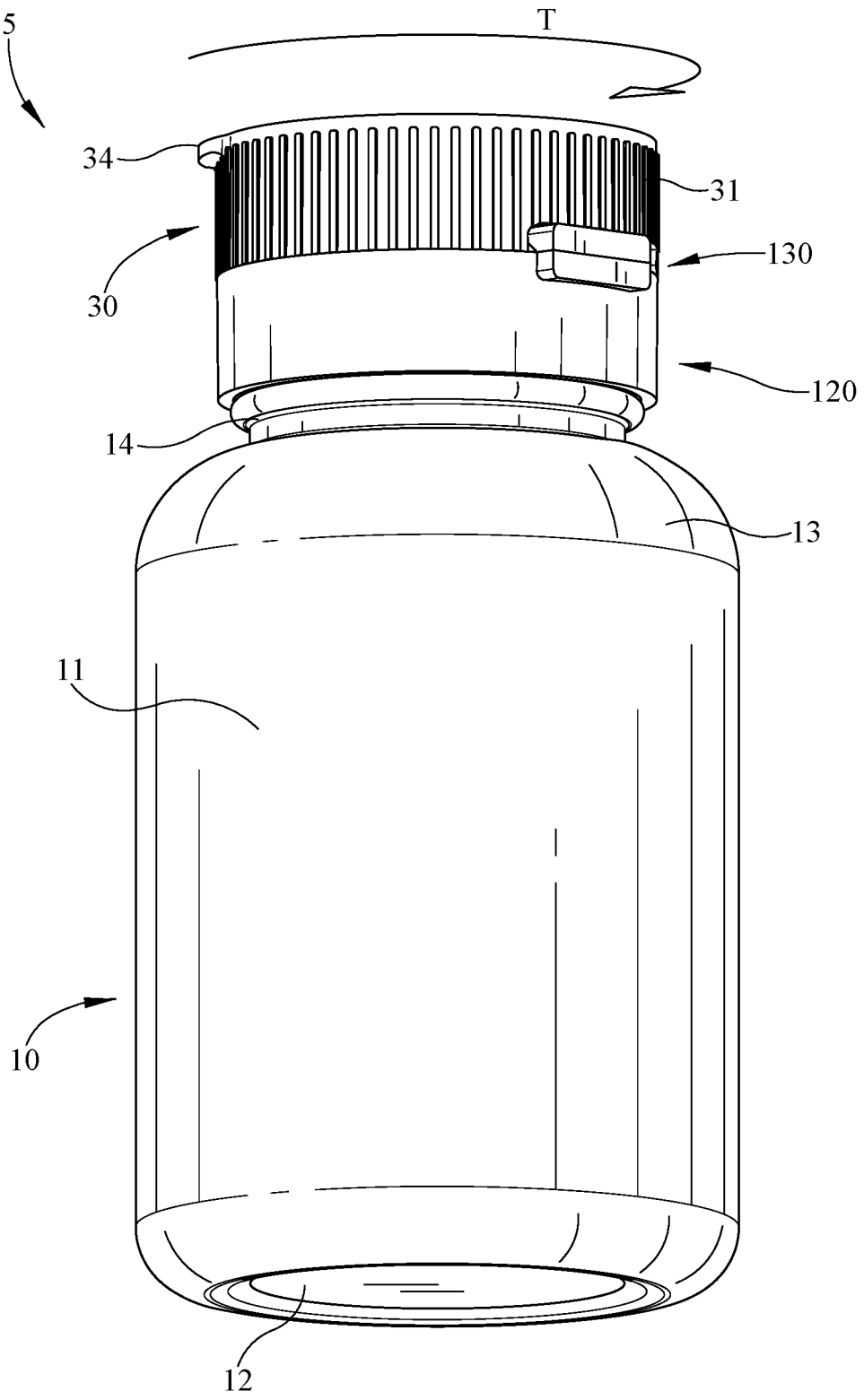
FIG. 9 illustrates a back perspective view of the package of FIG. 8, showing the locking collar in an unlocked position, with the closure hinge now on the other side of the slot.

FIGS. 8 and 9 show an embodiment of package 5 in a locked position and an unlocked position, respectively. FIGS. 8 and 9 illustrate a back perspective view of package 5, showing hinge 130 connecting base 120 and lid 110. FIG. 8 shows package 5 in the locked position, in which a portion of hinge recess 38 of collar 30 is visible. Hinge recess 38 may be configured to allow collar 30 and/or collar side wall 31 to move or rotate relative to hinge 130 without hinge 130 interfering with that motion until recess 38 ends and hinge 130 contacts side wall 31. Hinge recess 38 may be configured so that when it ends and side wall 31 contacts hinge 131, collar base beads 37 are in alignment with unlocking slots 127. In this way, for example, hinge 130 and/or hinge recess 38 may provide and/or facilitate an alignment mechanism to inform a user when the collar base beads 37 and unlocking slots 127 are in alignment and/or the collar is in the unlocked position. Such an arrangement could help a user locate the unlocked position by applying twist T without, for example, rotating collar 30 too far and/or past the unlocked position to another locked position.

Figure 10:
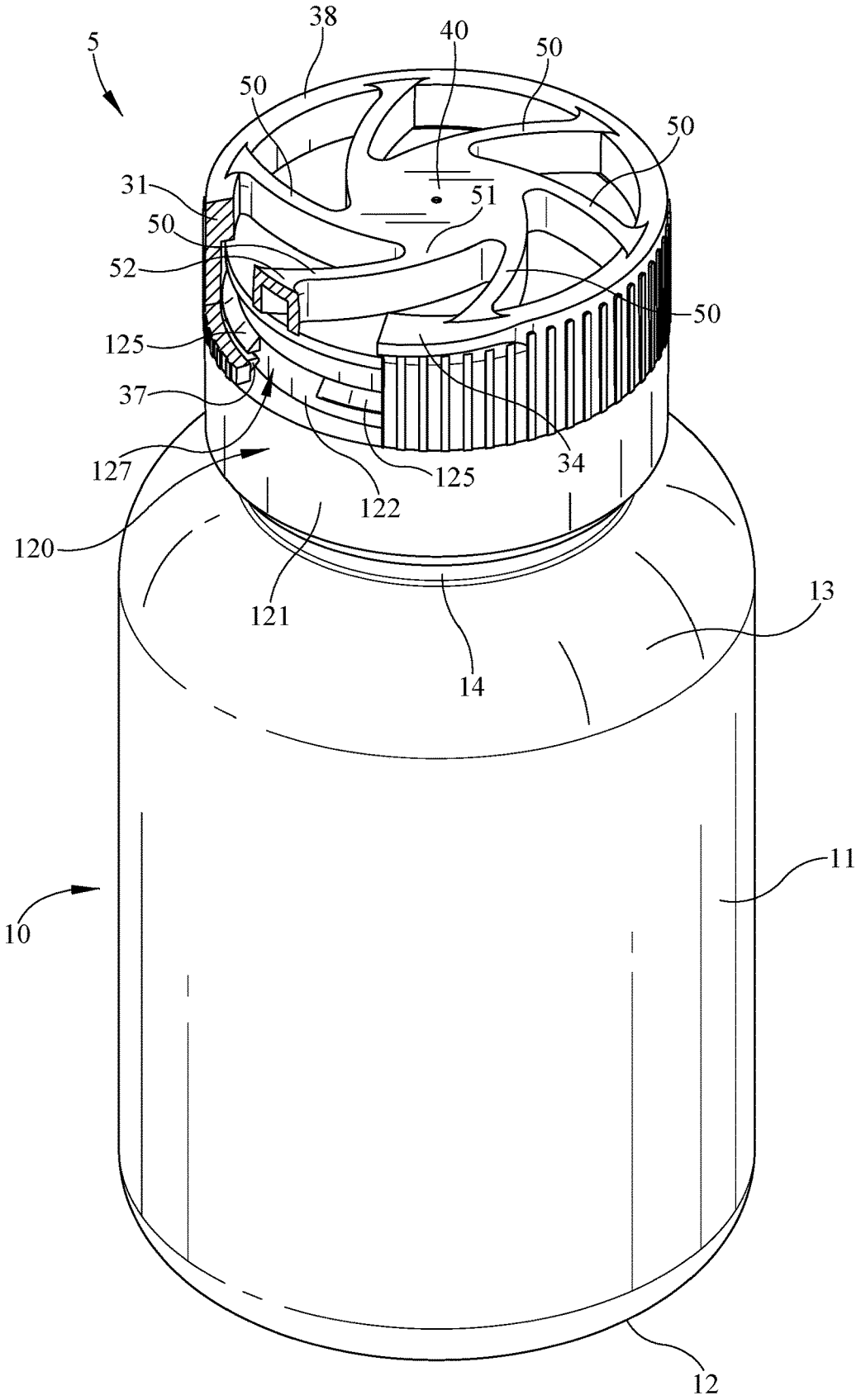
FIG. 10 illustrates a perspective view of the package of FIG. 1 in the locked position, with a portion of the locking collar shown cut away to show an embodiment of a locking mechanism in more detail.

FIG. 10 illustrates package 5 in the locked and closed positions. Collar base beads 37 are in alignment with base locking protrusions 125 and not in alignment with unlocking slots 127. Locking protrusions 125 may prevent moving lid 110, closure 20, and/or package 5 from the closed position to the open position by blocking collar base beads 37 from moving vertically, for example. Spokes 50 are shown in a resting condition in the locked position.

Figure 11:
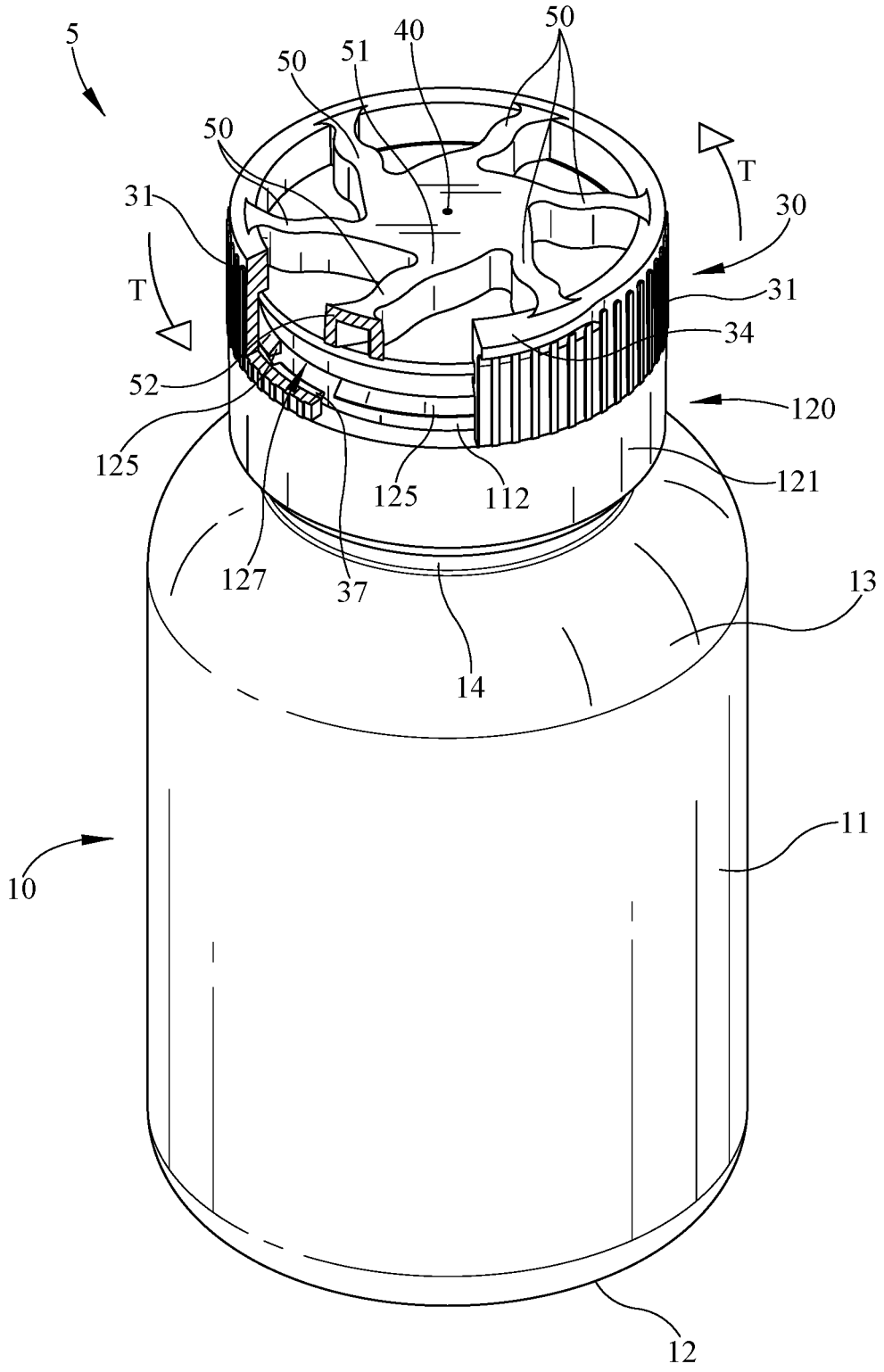
FIG. 11 illustrates a perspective view of the package of FIG. 1 in the unlocked position, with a portion of the locking collar shown cut away to illustrate the locking mechanism unlocked to allow opening of the package.

FIG. 11 illustrates package 5 in the unlocked position when subject to first user input and/or twist T that overcomes the bias of spokes 50. In the unlocked position, collar base beads 37 are in alignment with unlocking slots 127 so that collar base beads 37 may pass through unlocking slots during movement in a vertical direction moving lid 110 from the closed position to the open position. In the unlocked position, spokes 50 are deformed and provide a biasing force counter to twist T toward the locked position so that, for example, collar 30 may return to the locked position in the absence of first user input and/or twist T.

Closure 20 may couple, connect, and/or attach to container 10 by an attachment mechanism such as the threaded engagement between neck threads on container neck 14 and base threads on closure base 120. Other attachment mechanism may be included instead of or in addition to threaded engagement, such as snap fit, friction fit, and/or integral formation of closure 20 and container 10, for example. Lid 110 may include lid lip 113 disposed away from hinge 130, for example, diametrically opposed hinge 130, for example, to facilitate opening of lid 110 relative to base 120.

Package 5 and/or closure 20 may be provided in an open position, for example, with closure 20 in an open position with lid 110 rotated relative to base 120 about hinge 130 (not shown in the figures). In the open position, product storage region may be accessible by a user via one or more openings in base 120 and/or neck 14. These openings may be substantially blocked by lid 110 or cover 111 when lid 110 is in the closed position.

It is understood that package 5 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), thermoplastic elastomer (TPE), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 5 or any component thereof may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 5.

It is further understood that any of a variety of processes or combination thereof may be used to form package 5 and/or bottle or container 10, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, container 10 and/or any component thereof may be formed substantially of injection stretch blow molded PET, although other materials and forming processes may be used instead of or in addition to PET and injection stretch blow molding, respectively. Various materials and/or processes may be used to form package 5 and/or any component thereof as will be understood by one of ordinary skill in the art. In some embodiments, bottle 10 may be substantially a one-piece design and/or substantially formed as an integral or unitary structure.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container defining a product storage region; and a closure having a base and a lid;

wherein the base is coupled to the container and the lid is movable relative to the base between a closed position and an open position;

a locking protrusion on the base that extends in a radial direction from the base;

a collar coupled to the lid and having a side wall that is movable between a locked position, in which it prevents the lid from opening, and an unlocked position in which it allows the lid to open; and a collar base bead extending in a radial direction from the collar side wall;

wherein the locking protrusion on the base and the collar base bead are in vertical alignment to prevent opening of the lid when the lid is in the closed position and the collar is in the locked position;

wherein the collar is configured to be moved from the locked position to the unlocked position by a first user input, with the collar base bead out of vertical alignment with the locking protrusion to allow opening of the lid; and wherein the lid is movable from the closed position to the open position by a second user input;

wherein the collar includes a hub and at least one spoke, wherein the hub is prevented from rotating relative to the lid, the collar is allowed to rotate relative to the lid, and the at least one spoke is deformable from a resting condition when the collar is in the locked position to a deformed condition when the collar is in the unlocked position.

2. The package of claim 1, wherein the lid is rotatable relative to the base about a hinge.

3. The package of claim 1, wherein the collar is attached to the lid by at least one of cooperating beads and lips to allow the collar to rotate relative to the lid and to substantially prevent vertical motion of the collar relative to the lid.

4. The package of claim 1, wherein the base includes a skirt, a shoulder, and a rim, wherein the rim is disposed at the top of the base and defines an opening through the base, the shoulder is disposed below the rim, and the skirt is disposed below the shoulder, wherein the skirt extends radially outwardly farther than the shoulder.

5. The package of claim 1, wherein the base is permanently attached to the container.

6. The package of claim 5, wherein the base is permanently attached to the container by a snap fit.

7. The package of claim 1, wherein the collar includes a hinge recess.

8. The package of claim 1, wherein the hub is prevented from rotating relative to the lid by the engagement of at least one of a collar attachment portion and a lid attachment portion.

9. The package of claim 1, wherein the at least one spoke includes a center component formed of a first material and an outer component formed of a second material.

10. The package of claim 9, wherein the center component is formed of substantially the same material as the hub and the collar side wall and the outer component is formed of a different material.

11. The package of claim 10, wherein the outer component is formed of a thermoplastic elastomer (TPE).

12. The package of claim 11, wherein the collar is formed by first molding the hub, spoke center component, and side wall, and subsequently overmolding the outer component onto the center component.

13. The package of claim 1, wherein a plurality of locking protrusions are circumferentially separated by at least one unlocking slot, wherein the collar base bead is aligned with the at least one unlocking slot and configured to pass vertically through the at least one unlocking slot when the collar is in the unlocked position to allow opening of the lid relative to the base.

14. A closure and collar for a container, comprising:

a base and a lid;

wherein the lid is movable relative to the base between a closed position and an open position;

a locking protrusion on the base that extends in a radial direction from the base;

a collar coupled to the lid and having a side wall that is movable between a locked position, in which it prevents the lid from opening, and an unlocked position in which it allows the lid to open; and a collar base bead extending in a radial direction from the collar side wall;

wherein the locking protrusion on the base and the collar base bead are in vertical alignment to prevent opening of the lid when the lid is in the closed position and the collar is in the locked position;

wherein the collar is configured to be moved from the locked position to the unlocked position by a first user input, with the collar base bead out of vertical alignment with the locking protrusion to allow opening of the lid; and wherein the lid is movable from the closed position to the open position by a second user input;

wherein the collar includes a hub and at least one spoke, wherein the hub is prevented from rotating relative to the lid, the collar is allowed to rotate relative to the lid, and the at least one spoke is deformable from a resting condition when the collar is in the locked position to a deformed condition when the collar is in the unlocked position.

15. The closure and collar of claim 14, wherein the hub is prevented from rotating relative to the lid by the engagement of at least one of a collar attachment portion and a lid attachment portion.

16. The closure and collar of claim 14, wherein the at least one spoke includes a center component formed of a first material and an outer component formed of a second material.

17. The closure and collar of claim 14, wherein the base includes a skirt, a shoulder, and a rim, wherein the rim is disposed at the top of the base and defines an opening through the base, the shoulder is disposed below the rim, and the skirt is disposed below the shoulder, wherein the skirt extends radially outwardly farther than the shoulder.

18. A package, comprising:

a container defining a product storage region; and a closure having a base and a lid;

wherein the base is coupled to the container and the lid is movable relative to the base between a closed position and an open position; and a collar having a side wall that is movable between a locked position, in which it prevents a user from opening the lid, and an unlocked position in which it allows the user to open the lid; and wherein the collar is rotatable relative to the base by a user input to move the collar between the locked position and the unlocked position;

wherein the collar includes a hub and at least one spoke, wherein the hub is prevented from rotating relative to the lid, the collar is allowed to rotate relative to the lid, and the at least one spoke is deformable from a resting condition when the collar is in the locked position to a deformed condition when the collar is in the unlocked position.

19. The package of claim 18, wherein the hub is prevented from rotating relative to the lid by the engagement of at least one of a collar attachment portion and a lid attachment portion.

20. The package of claim 18, wherein the at least one spoke includes a center component formed of a first material and an outer component formed of a second material.

* * * * *